United States Patent [19]

Payne

[11] 4,057,961

[45] Nov. 15, 1977

[54] PULSE-JET WATER PROPULSOR

[76] Inventor: Peter R. Payne, Rte. 5, Box 282, Annapolis, Md. 21401

[21] Appl. No.: 580,096

[22] Filed: May 22, 1975

Related U.S. Application Data

[63] Continuation-in-part of Ser. No. 358,232, May 8, 1973, Pat. No. 3,898,800.

[51] Int. Cl.[2] ..... B63H 11/06

[52] U.S. Cl. ..... 60/221; 92/134; 417/10; 417/380; 417/401; 60/595; 60/596; 115/11; 115/14

[58] Field of Search ..... 417/364, 380, 401, 10; 60/595, 596, 221; 92/134; 115/11, 14

[56] References Cited

U.S. PATENT DOCUMENTS

| | | | |
|---|---|---|---|
| 550,163 | 11/1895 | Durand | 60/407 |
| 2,795,927 | 6/1957 | Huber | 60/596 |
| 3,170,406 | 2/1965 | Robertson | 417/364 X |
| 3,214,085 | 10/1965 | Boldt | 417/364 |
| 3,631,760 | 1/1972 | Moran | 92/134 X |

*Primary Examiner*—Allen M. Ostrager
*Attorney, Agent, or Firm*—Sughrue, Rothwell, Mion, Zinn and Macpeak

[57] ABSTRACT

A new heat engine in which liquid moves in a tube, one end of which is closed. The tube is heated at the closed end, and the liquid oscillates along the length of the tube. When the liquid interface enters the hot section, some of the interface vaporizes, so that the pressure in the space between the interface and the end of the tube increases, and the interface is forced back into the cooler section of the tube. The vapor then condenses, the pressure falls, and the liquid moves back toward the hot end.

The longer the tube in relation to size of the hot section or "boiler," the greater the momentum of the liquid when it enters the boiler, and the higher the peak pressure ratio which is developed. High pressure ratios are essential for efficient operation. It is also generally necessary for the boiler walls to be heavy enough to "store" the heat required for one complete cycle, and to be able to reject it to the water during the very short time that the interface is within the boiler.

Embodiments using compressed air and diesel cycles are disclosed which take the place of the fluid-vapor interface by utilizing a driven piston.

1 Claim, 7 Drawing Figures

PULSE-JET WATER PROPULSOR

CROSS-REFERENCE TO RELATED APPLICATION

This application is a continuation-in-part of application Ser. No. 358,232 filed on May 8, 1973 now U.S. Pat. No. 3,898,800.

BACKGROUND OF THE INVENTION

1. Field of the Invention

This invention relates to a new heat engine particularly adaptable for use with water as a working fluid and producing useful energy by the pulse-jet principle.

2. Description of the Prior Art

In boat propulsion, it is conventional to start with a source of energy, e.g., fuel, which produces heat energy and to impart kinetic energy to the ambient water, so that the boat will be pushed forward by reaction. It is usual to have a great deal of machinery between these two extremes. For example, the fuel heats water in a boiler to make steam, which drives a turbine, which drives a water propeller via a gearbox, which develops a reactive thrust. In the present invention, the heat is applied directly to the ambient water in order to achieve the same effect, thus eliminating the intervening machinery. A known propulsive unit of this general type was patented by McHugh in 1916 (U.S. Pat. No. 1,200,960) and the principle of his engine is illustrated in FIG. 1. Assuming that there is initially some water in the boiler, the heat turns it to steam and pushes the ambient water interface down the tube. When all the water in the boiler has been turned to steam, the steam condenses in the cool section of the pipe, the pressure drops, and the water interface moves back toward the boiler. When it reaches the boiler, some water splashes in, and because the tube is raised above the floor of the boiler, this splashed water is trapped and is again turned to steam, pushing the interface down the tube. A net thrust force to the left is produced, principally because when the ambient water is flowing into the tube, it comes from all directions (a "sink" flow) while when it emerges, it comes out as a jet, because finite fluid viscosity prohibits "source" flows from a pipe (see FIG. 2*b*). Numerous other later patents all operate on the same principle of trapping a small quantity of water in the boiler at the end of each induction phase.

McHugh's invention was specifically for a toy boat, and most of the following inventors specify or imply the same application. It was recognized that the principle could not be scaled up to "full scale" boats principally because many people had attempted to accomplish this, particularly in the early 1920's without success. There were two key reasons for this inability to scale up the phenomena. Firstly, the steam-water interface, shown in FIG. 1, was preserved by surface tension, and this is only possible in very small diameter tubes. In larger tubes, there was no stable interface, and the steam bubbled into the ambient water and was condensed without moving the bulk of the water in the tube. More importantly, even if this problem has been solvable, the pressures developed were inherently low so that there was no possibility of achieving efficient operation.

Also, U.S. Pat. No. 3,013,384 disclosed a device of general interest in which the tubular member is not closed at one end but has a water injector. Water is passed through the tube which contains pulse arc means therein to heat the fluid itself. The working fluid does not oscillate within the tube, but rather is injected, vaporized and expanded.

SUMMARY OF THE INVENTION

As illustrated in FIGS. 2(*a* and *b*) and 3, the "boiler" is an integral part of the tube, and the momentum acquired by the water column as it moves toward the boiler is relied upon to hold the interface in the boiler long enough to produce a useful quantity of steam at high pressure. Stability of the interface between the steam and the water is obtained because, for most of the cycle, the water column is being accelerated toward the boiler. It is only accelerated away from the boiler when close to it or actually inside it, and this leaves very little time for the then unstable interface to actually disintegrate.

A P-V diagram of the unit's operation is given in FIG. 3. For most of the cycle, the steam is condensing and the interface is slowing down from its initial rapid explusion from the boiler. A "condensing section" is formally required, but in many practical cases, contact of the exhaust end of the tube with the ambient fluid is sufficient to provide this heat sink.

Since the fluid interface is in the boiler for only a very short period of time, it is important that sufficient heat for one cycle be "stored" in the boiler wall material, and that this heat be released to the water rapidly. This implies either a material having high conductivity and high specific heat or a material having high conductivity and substantial weight.

The copending application discloses these basic concepts.

As shown in FIG. 4, this invention utilizes a high speed pulse jet having an inlet valve and an internal piston cycle. Initially charged with water downwards motion of the piston results in a pressure build-up which closes the intake valve and expels a propulsive jet to the exhaust. When the pressure above the piston has fallen to a sufficiently low value, the downward movement is terminated and the piston starts to rise, allowing a fresh charge of water to enter the intake valve. The piston is driven by pressure changes above it, in the same sense as any conventional engine, and these pressure changes may be induced in any of a variety of conventional ways using internal combustion (Diesel, Ott cycles), vapor (Rankine cycle) or gas pressure change (Stirling, Ericsson or Roesel cycles).

Also, as shown in FIG. 5 the same principles utilized in the propulsive system can be employed in a different configuration. This is shown schematically, utilizing a supply of compressed air. These systems can be employed as pumps if the exhaust or exit is removed from the liquid.

DETAILED DESCRIPTION OF PREFERRED EMBODIMENTS

Figure 1:
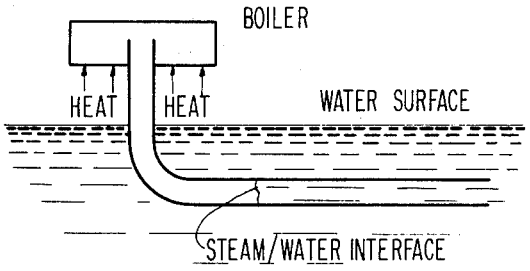
FIG. 1 PRIOR ART
FIG. 1 is a schematic illustration of the prior art water pulse-jets.

FIG. 1 is a typical prior art construction in which heat is applied to a boiler and a tube extends upwardly into the boiler. The disadvantages of such a construction and its limitations and lack of ability to scale it up have been described above.

Figure 2B:
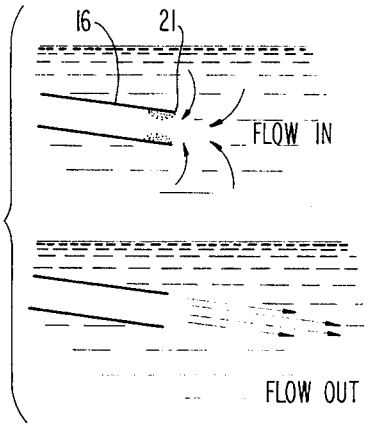
FIG. 2 is an illustration of the flow in and out of the open end of the tube of the invention of my copending application.
Figure 2A:
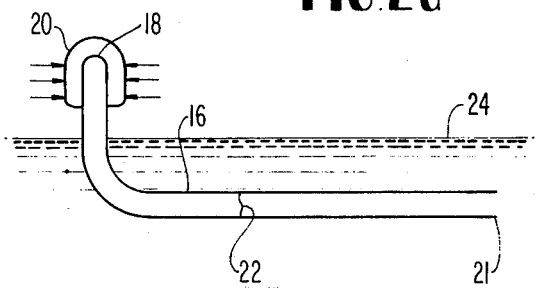
Figure 3:
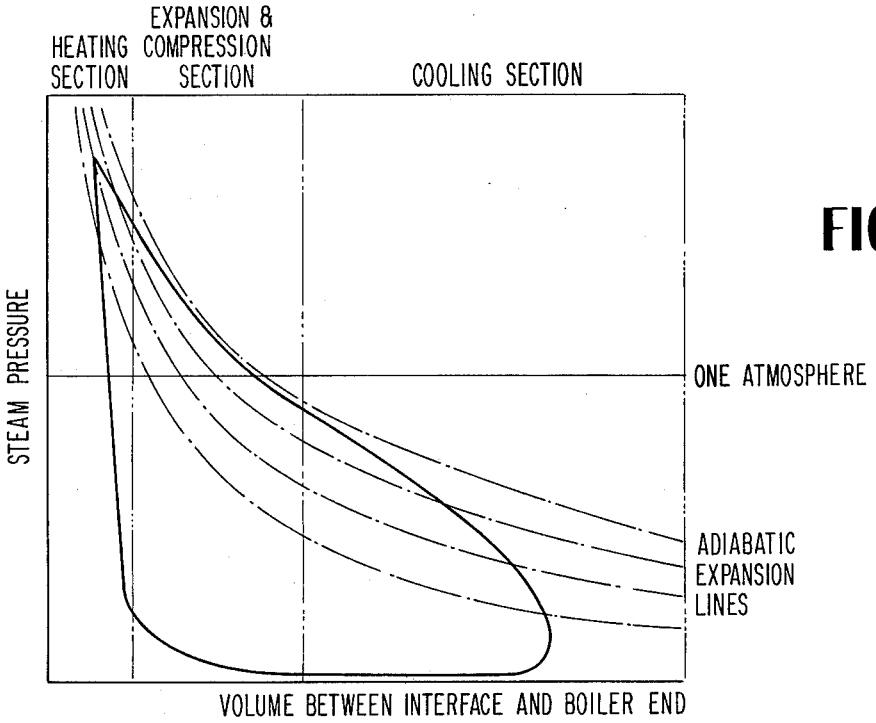
FIG. 3 is a pressure-volume-diagram of the new cycle upon which the invention operates.

FIG. 2*a* illustrates the basic concept of the water jet propulsion system in which a tube 16 has one closed end 18 and one spin end 21. Heat is applied to an area adjacent the closed end 18 which may be termed a "boiler" 20. The heat causes water in the tube 16 to vaporize and push the interface 22 to the right as viewed in FIG. 2*a*. After a portion of the steam within the tube 16 has condensed and the temperature of the remaining steam has been lowered by virtue of contact with the water 24, the volume of the remaining steam contracts and interface 22 moves back to the left for additional water to be heated in the boiler. FIG. 3 shows the P-V diagram for this cycle.

FIG. 2*b* illustrates the problems with the open end 21 of the tube 16 during the flow in and out of the tube. During flow in, there is a region of separated flow as illustrated unless a bell-mouth shape is employed. Additionally if separate inlet and outlet ports are provided, performance is enhanced. These characteristics are more fully described in my copending application.

This invention builds on these concepts by providing for a bifurcated body, for a separate inlet and outlet and additionally utilizing a piston in the tube as the fluid driving component. The problems maintaining the steam-water interface, set forth in my copending application are thereby eliminated.

The water pulse-jet of this invention in it most basic form comprises a bifurcated body having an inlet and outlet. The main body contains a piston driven by the steam-water interface. During the power, or exhaust stroke, the piston is urged downward and the inlet is closed by suitable valve techniques to prevent the escape of fluid. During the intake or induction stroke the inlet valve opens to admit fluid thereby driving the piston in an upward direction. The valve on the outlet is closed. The resulting interface again initiates the power stroke and the cycle continues.

Figure 4:
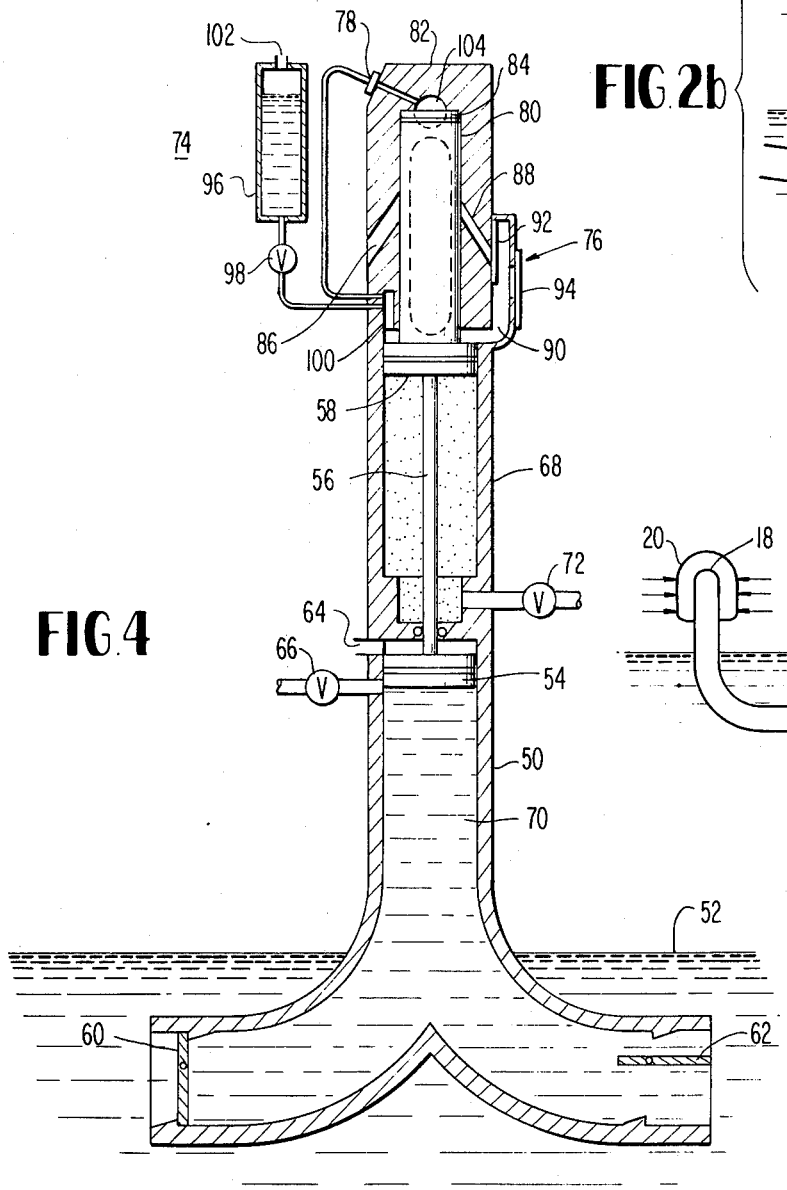
FIG. 4 is a schematic illustration of the water pulse-jet of this invention.

A practical embodiment of the means for generating the thrust to drive the piston is shown in FIG. 4 wherein a double piston diesel arrangement is shown as the driving mechanism. The system consists of a reciprocating pump driven by a two-stroke cycle diesel engine. The pumping mechanism and engine are integrated into a single assembly without the customary engine fly wheel, clutch, or gearbox. The pump consists generally of a vertical cylinder 50 with a T at the lower end, disposed below the water level shown generally at 52. Within the pump assembly there is disposed a liquid ram 54 coupled by a connecting rod 56 to an air ram 58. Two check valves 60, 62 are placed in a horizontal section of the T so that liquid can flow through in one direction only. An air vent 64 is disposed in the cylinder wall 50 and an air bleed valve 66 is located at the uppermost position of the liquid column inside the cylinder. A return spring mechanism comprises a cylinder of trapped air shown schematically at 68 and the air ram 58 which is connected by connecting rod 56 to the liquid ram 54. This air cylinder 68 is aligned with and located above the liquid cylinder shown at 70 inside the pump mechanism. A valve 72 is located at the lower end of the air cylinder in order to add or move air to vary the spring rate for differing conditions. This valve 72 is normally closed in a manner corresponding to the normally closed position of air bleed valve 66.

The engine itself consists of a power head 74, a vacuum pump mechanism 76 and a fuel injection system shown schematically at 78. The power head 74 comprises a cylinder 80, a head 82, a piston 84, air inlet and exhaust port 86, and a scavengering port 88.

The vacuum pump 76, is used to remove residual products of combustion from the cylinder and to induct fresh air into the cylinder during the latter portion of the downstroke. It consists of that part of the air cylinder which is located above the air ram 58, the annular area formed where the piston 84 joins the air ram, a duct which connects the top of the air cylinder to the scavenged port shown at 90, and two check valves 92 and 94. One check valve 92 permits gas to flow in one direction only from the cylinder into the vacuum pump during the downstroke. The other check valve permits gas to flow in one direction only from the vacuum pump to atmosphere during the upstroke.

The fuel injection system 74, consists generally of a fuel tank 96, a throttle mechanism 98, a fuel pump 100, and a fuel injector or nozzle 78. The fuel tank 96 contains a vent 102 in a manner conventionally known.

The engine is aligned above the pump mechanism. Power is transmitted between the engine and the pump by fastening the piston 84 to the air ram 58. Spring loaded rings having a low coefficient of friction are used to minimize leakage along the piston, rams, and connecting rod. A lubrication system (not shown) is provided for all moving parts. The lubrication system is generally similar to the fuel system, except that lubricating oil injectors are located at several points along the cylinders.

The principle of operation of the device shown in FIG. 4 will now be explained. With the throttle 98 closed, the air cylinder 68 is pressurized sufficiently to drive the piston and rams to their uppermost positions (top dead center). The air bleed valve 66 is then opened and air is pumped out of the liquid cylinder such that the liquid column 70 contacts the lower surface of the liquid ram 54. The bleed valve 66 is then closed. It should be noted that some air could be allowed to remain between the liquid and the ram, if performance is improved by the additional spring. The throttle 98 is then opened allowing fuel to flow into the fuel pump 100 so that injection will take place at the end of each upstroke following the starting stroke.

The starting stroke is produced by injecting a fixed quantity of starting fuel into the combustion chamber 104 and simultaneously opening the air cylinder valve 72 for a brief period of time so that the proper mass of air is confined in the air cylinder for the desired spring characteristics. The rise in temperature of the air in the combustion chamber due to the previous adiabatic compression causes ignition of the starting fuel, which results in a further rise in pressure and temperature. The rise in combustion chamber pressure and the drop in air cylinder pressure forces the piston and rams to move down their respective cylinders.

In normal operation, the internal pressure exceeds the external pressure at the pump ports. Therefore, the inlet check valve 92 closes, the outlet check valve 94 opens and liquid starts to flow out through the output port 62. Depending on the fuel flow rate relative to the rate of increase in gas volume, the gas pressure may be constant, may rise, or may first rise and then be held constant while the fuel is burning. The piston 84 continues its downward travel causing an expansion of the gas. When the fuel has been consumed, combustion ceases and the gas undergoes an adiabatic expansion causing its temperature and pressure to decrease. When the piston uncovers and thus opens the air inlet and main exhaust port 86, most of the energy in the gas has been expended in doing work on the load. At this time, the products of combustion are exhausted to the atmosphere during which time, the pressure in the cylinder drops from about 4 atmospheres to about 1 atmosphere.

During the downstroke, a vacuum is produced in the vacuum pump 76 due to the adiabatic expansion of air in the annular region between the piston and the air cylinder. When the downstroke begins, the pressure in this region is at atmosphereic and the volume is a minimum. Therefore, the increase in volume resulting from the downward travel of the air ram causes the pressure to drop below atmospheric. When the piston moves down sufficiently to uncover and therefore open the scavengering port, the remaining products of combustion flow from the cylinder, pass the scavenged port check valve 92 into the vacuum pump and fresh air flows into the cylinder through the air inlet and main exhaust port to replace the scavenged gas.

While the above sequence has been occurring within the engine section, liquid is pushed out of the pump by the liquid ram 54 and the air located below the air ram has been compressed adiabatically causing its pressure and temperature to rise (i.e., the driving force of the piston has been acting against a mass of liquid and a return spring). The driving force is exerted from the uppermost piston position when ignition occurs to the exhaust port position when the cylinder pressure drops to atmospheric level. This may be deemed the powered portion of the downstroke. The piston continues its downward travel past the main exhaust port 86 because of the momentum of the piston ram assembly and the column of liquid.

When the force of the return spring (or the air pressure) is sufficient to overcome the downward momentum, the piston reverses direction and starts to move up the cylinder. At this time, the internal pressure exceeds the external pressure at the pump ports, therefore the outlet check valve 62 closes, the inlet check valve 60 opens and liquid flows into the pump and up the liquid cylinder through the inlet port. It is noted that the energy possessed by the liquid which has departed the pump is greater than when it entered the pump. As the piston-ram assembly moves up, the volume in the vacuum pump 76 decreases and the resulting adiabatic compression of the contained gas causes a rise in pressure which becomes sufficient to open the outlet check valve 94 of the vacuum pump and scavenged air, contaminated with the products of combustion is exhausted to the atmosphere. During the lower portion of the upstroke, there is an inadvertent loss of clean air from the cylinder via the air inlet and main exhaust port 86. When the air inlet and main exhaust port is covered and therefore closed by the rising piston, an adiabatic compression of the trapped air commences, causing a rise in pressure and temperature. Scavenged air continues to be exhausted from the vacuum pump during the remainder of the upstroke. The rise in air pressure in the combustion chamber coupled with reduction in pressure of the expanding air in the air cylinder results in a force that eventually overcomes the upward momentum of the piston-ram assembly and column of liquid. The piston stops and then reverses direction. When the piston arrives at its uppermost position, a metered quantity of fuel is injected into the compressed air in thecombustion chamber. The fuel is atomized by a nozzle so that it quickly vaporizes and mixes with the air. The temperature of the compressed air is high enough to ignite the fuel-air mixture and combustion commences, causing a rise in thermal and mechanical energy of the gas. The rise in combustion chamber pressure accelerates the downward motion of the piston-ram assembly in the liquid column. The sequence of operations herein described are then repeated for each succeeding cycle.

One important variation of this system over the conventional two stroke diesel engine cycle lies in the fuel injection system which is similar except for the proper timing of fuel injection which, in a conventional engine is easily accomplished by actuating the fuel pump plunger with a cam that moves continuously in one direction only due to the uni-directional rotation of the cam shaft. In the present system, however, the fuel pump plunger is pushed in toward the fuel pump by the rising air ram just prior to arriving at its uppermost position and then, the plunger is released and returns to its outboard position through the action of a return spring when the piston and air ram have moved down a short distance from their uppermost positions. With a conventional fuel pump, fuel is injected when the plunger is pushed inboard, therefore, combustion may start slightly before the piston reverses direction if a conventional fuel pump is used with the system described herein. If this presents a problem, fuel injection may be delayed slightly by means of an accumulator and orifice in the fuel line between the fuel pump and nozzle or by designing the fuel pump to inject fuel when its plunger is released rather than when the plunger is pushed in.

Initiation of the fuel injection before the piston reverses direction may not be a problem because there is an inherent delay in combustion and the compressability of the fuel results in a transportation lag or delay. Therefore, pumping of the fuel before the piston reverses direction, may result in combustion after the piston reverses direction, as is generally desired for optimum performance. In conventional engines having a rotary output shaft, combustion occurring before the piston reverses direction could result in excessive forces and stresses on the connecting rod and crank shaft. This, however, is not a problem for the free piston engine described herein.

Figure 5:
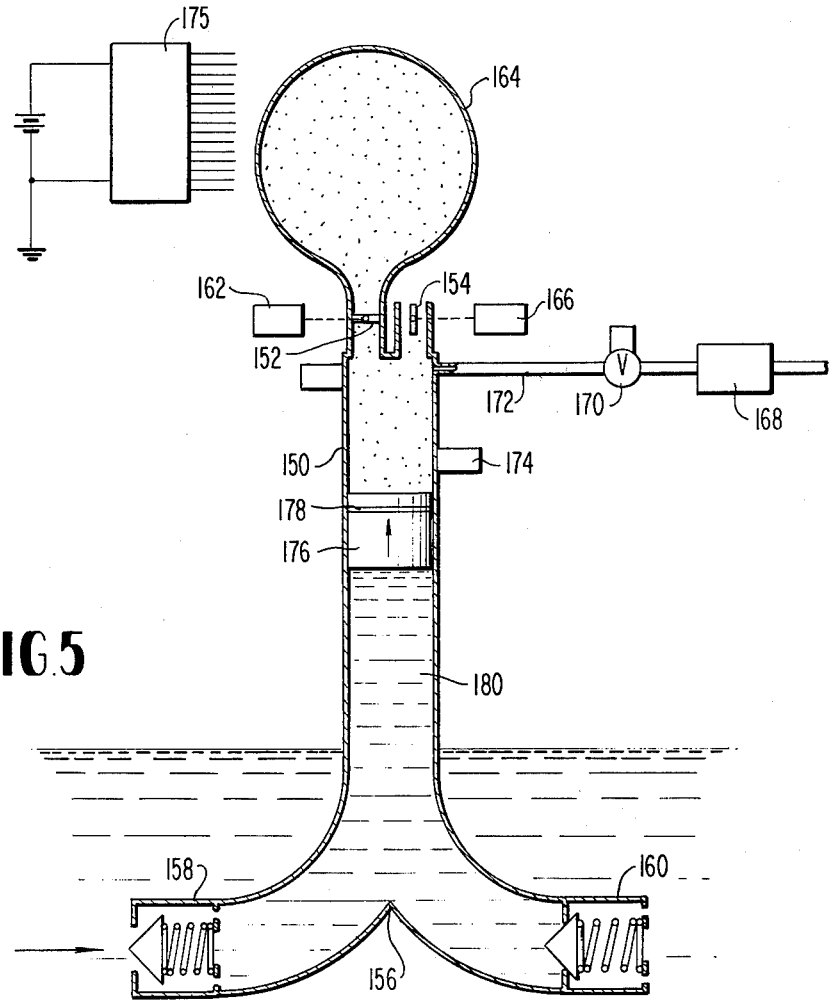
FIG. 5 is a schematic illustration of a second form of pulse-jet utilizing compressed air as the driving mechanism.

FIG. 5 shows a second embodiment of this invention utilizing a compressed air drive liquid pump in place of the double piston diesel embodiment previously described. This system consists primarily of a vertical cylinder 150 with two valves 152, 154 at the upper end and a tee 156 at the lower end. As in the prior embodiment, a first check valve 158 is placed at the liquid inlet and a second check valve 160 is located at the liquid outlet. The supply valve 152 is coupled via an actuator 162 to a source of compressed gas 164, typically compressed air or steam. The gas exhaust valve 154 is coupled via an actuator 166 and vented to atmosphere. Each of the actuators 162, 166 are typically spring loaded solenoids. However, alternative actuators may consist of hydraulic or pneumatic rams controlled by a solenoid valve. A vacuum pump 168 and a vacuum valve 170 coupled via conduit 172 to the cylinder 150 are utilized to start the pump. The system is controlled by a liquid level position switch 174 and associated electrical components. A piston 176 having suitable rings 178 to generate the necessary compression is located between the liquid 180 in the cylinder 150 and the gas region. The piston is required between the liquid and gas to activate the liquid level position switch 174.

In operation, the pump is started by closing both gas valves, opening the vacuum valve and operating the vacuum pump. When a vacuum is produced at the top of the cylinder, atmospheric pressure at the liquid inlet forces liquid to flow through the inlet check valve 158 and up near the top of the cylinder. The vacuum valve 170 is then closed when the liquid rises to a predetermined level and the vacuum pump is turned off. The gas supply valve 152 is opened and then closed after a brief period of time. The compressed air admitted to the top of the cylinder forces the column of liquid to move down the cylinder and out through the outlet check valve 160. Since the internal pressure exceeds the external pressure at the inlet check valve, the check valve is closed thus preventing flow out through the inlet port.

As the column of liquid moves down the cylinder, the gas above it expands approximately adiabatically and therefore the gas pressure and temperature decrease. Before the liquid level reaches the tee at the bottom of the cylinder, the gas pressure drops below atmospheric and the resulting pressure gradient overcomes the downward momentum of the liquid column and forces it to reverse direction and flow upward. At this time, the outlet check valve 160 closes and the inlet check valve 158 opens allowing water to be admitted through the inlet port. Since the gas is now being compressed by the rising column of fluid, its pressure and temperature rise. When the gas pressure rises to atmospheric, the exhaust valve is opened to the atmosphere. The low energy gas can now escape with very little additional rise in pressure and therefore the upper flow of liquid is not slowed down by gas compression at this stage of operation.

When the liquid rises to a predetermined level near the top of the cylinder, the exhaust valve 154 is closed and the supply valve is opened. After a short period of time the supply valve is closed again. Thus, a high energy compressed gas mass has been admitted and then trapped in the space above the liquid column. The momentum of the column of liquid causes it to continue to travel upward, compressing and rising the pressure of the trapped gas. The gas temperature also rises since the compression process is primarily adiabatic. The kinetic energy of the moving liquid is transferred to the gas where it is stored as potential energy. As the gas is compressed, the liquid velocity decreases until the gas pressure is sufficient to stop the liquid column and force it to reverse direction and move down the cylinder. Because the internal pressure near the check valve now exceeds the extra low pressure, the inlet valve is closed and the outlet valve is opened allowing liquid to flow through the outlet port. When the liquid level drops sufficiently, the gas pressure again decreases below atmospheric and the cycle is repeated.

It is apparent that the pump acts in a manner similar to a mechanically driven spring-mass-pot system with a periodic excitation force. This accounts for its oscillatory motion. The trapped gas acts as a spring, the column of liquid acts as a mass, resistance to the flow acts as a dash pot, and the periodic removal of low energy gas and the addition of high energy compressed gas act as an excitation or driving force. The spring is present at all times except during the mid-position of the intake stroke when it is removed by venting. The spring is then replaced when compressed gas is admitted.

Figure 6:
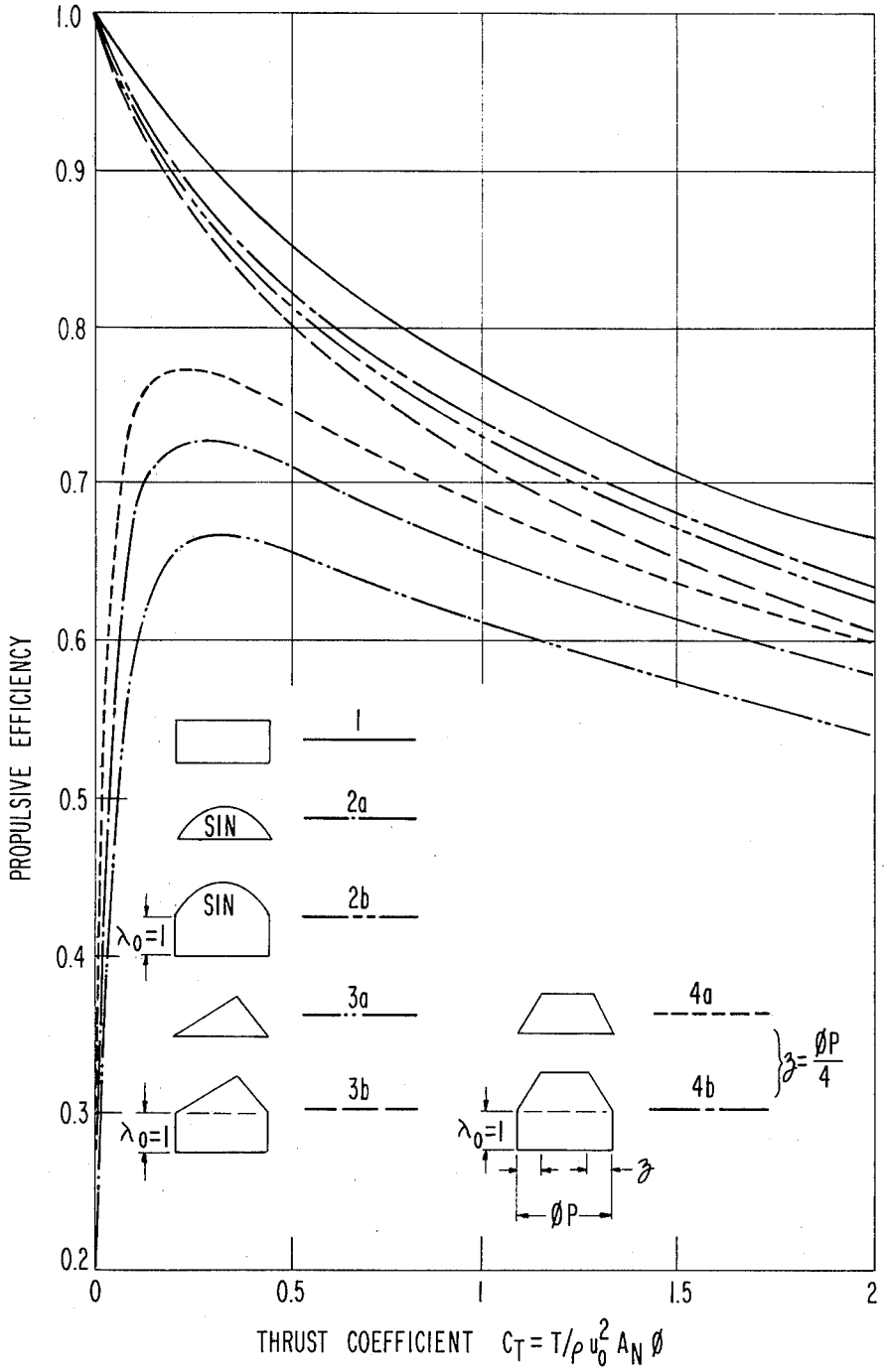
FIG. 6 is a diagram of propulsive efficiency of a pulse-jet as a function of Exhaust Velocity Time History shape.

Referring now to FIG. 6, a graph of the ideal propulsive efficiency of a pulse jet is a function of its exhaust velocity time history shape is shown. In this graph, seven different exhaust velocity time history shapes are plotted. Plot 1 represents a uniform rectangular velocity, plot 2 a sine pulse super velocity, plot 2B a sine pulse velocity, plot 3A a triangular super velocity, plot 3B a triangular super velocity, plot 4A a trapezoidal velocity and 4B a trapezoidal super velocity time history shape. In this graph, the thrust coefficient $C_T$ is equal to the thrust divided by the product of the water mass density ($\rho$) times $u_o^2$ being the square of the forward velocity of the unit times $A_N$ wherein $A_N$ is the cross-sectional area of the nozzle and $\phi$ equals the discharge time divided by the total period.

It is to be understood that the present invention is subject to many modifications and changes and therefore should not be limited by the abovementioned specification.

These devices are readily usable as pumps without changes in operative structure. If, for example, the outlet 62 of the FIG. 4 embodiment is disposed outside the fluid 52, the device will function to move water from the inlet, disposed in the fluid, to the outlet at some remote location.

What is claimed is:

1. A water pulse-jet engine comprising:

a. a tubular member, said tubular member being closed at one end and open at the other end to a source of water such that the water has access to said tubular member;

b. said open end having a bifurcated duct with inlet and outlet ports and valve means associated with each of said ports;

c. a piston disposed in said tubular member to urge said water out of said outlet port during movement in one direction in said tubular member and permitting water to flow into said tubular member during movement in the opposite direction, said valve means being coordinated with the movement of said piston by internal pressure variations in said bifurcated duct;

d. means for oscillating said piston in said tubular member thereby producing useful power by the movement of water through said outlet port, comprising a source of compressed air disposed at the closed end of said tubular member;

e. a vacuum system for initially starting the engine by evacuating the space between said piston and said closed end, comprising a vacuum valve, a conduit coupling said vacuum valve to said tubular member and a vacuum pump coupled to said vacuum valve;

f. valve means disposed at said closed end to selectively gate the compressed air into and out of the tubular member; and g. a liquid level sensor positioned in said tubular member, said liquid level sensor controlling the operation of said vacuum system in response to increased liquid level in said tubular member.

* * * * *